US009355797B1

(12) United States Patent
Cleaveland et al.

(10) Patent No.: US 9,355,797 B1
(45) Date of Patent: May 31, 2016

(54) UNITIZED PHASE OVER PHASE TWO-WAY OR THREE-WAY HIGH VOLTAGE SWITCH ASSEMBLY WITH ONE VACUUM INTERRUPTER PER PHASE

(71) Applicants: Charles M. Cleaveland, North Huntingdon, PA (US); Peter M. Kowalik, Trafford, PA (US)

(72) Inventors: Charles M. Cleaveland, North Huntingdon, PA (US); Peter M. Kowalik, Trafford, PA (US)

(73) Assignee: CLEAVELAND/Price INC., Trafford, PA (US)

( * ) Notice: Subject to any disclaimer, the term of this patent is extended or adjusted under 35 U.S.C. 154(b) by 0 days.

(21) Appl. No.: 14/672,180

(22) Filed: Mar. 29, 2015

Related U.S. Application Data

(60) Provisional application No. 62/078,637, filed on Nov. 12, 2014.

(51) Int. Cl.

| | |
|---|---|
| ***H01H 27/10*** | (2006.01) |
| ***H01H 31/28*** | (2006.01) |
| ***H01H 33/666*** | (2006.01) |
| ***H01H 33/02*** | (2006.01) |

(52) U.S. Cl.
CPC ..... *H01H 31/28* (2013.01); *H01H 33/022* (2013.01); *H01H 33/6661* (2013.01)

(58) Field of Classification Search
CPC . H01H 31/28; H01H 33/022; H01H 33/6661; H01H 31/00; H01H 31/283; H01H 31/20; H01H 31/30
USPC .... 200/42.01, 48 R, 48 P, 48 A, 48 KB, 48 V, 200/48 SB, 48 CB; 218/3, 9, 10, 119, 12
See application file for complete search history.

(56) References Cited

U.S. PATENT DOCUMENTS

| | | | | |
|---|---|---|---|---|
| 2,849,554 | A | 8/1958 | Curtis et al. | |
| 3,070,680 | A | 12/1962 | McBride | |
| 3,226,499 | A | 12/1965 | Curtis et al. | |
| 4,492,835 | A | 1/1985 | Turner | |
| 5,321,221 | A * | 6/1994 | Rozier | H01H 1/5833 218/2 |
| 6,946,607 | B2 * | 9/2005 | Roberts | H01H 31/006 200/48 A |
| 6,984,795 | B1 * | 1/2006 | Kowalik | H01H 31/28 200/48 CB |
| 8,541,702 | B2 * | 9/2013 | Blalock | H01H 31/20 200/48 R |
| 8,916,785 | B1 * | 12/2014 | Kowalik | H01H 1/48 200/48 A |

OTHER PUBLICATIONS

Turner Electric Corporation Sales Brochure, entitled Air Break Switch 3D-D001, Teco Air Switches 15KV-161KV, Copyright Turner Electric Corporation 1983, pp. 1-6.

* cited by examiner

*Primary Examiner* — Edwin A. Leon
(74) *Attorney, Agent, or Firm* — R. S. Lombard

(57) ABSTRACT

Switch gear for interconnecting a plurality of power transmission lines including a number of high voltage switches arranged in three phases for routing power in multiple directions. The switches are pre-mounted on a beam to form a three phase unit as a unitized assembly which is attached in the field to a vertical support structure. Each phase includes a vertical break switch and two side break switches for a three-way switch. For a two-way, each phase includes two side break switches. The vertical break switch and the two side break switches for each phase are operatively and electrically connected to a common electric power interrupter. The unitized assembly for each phase has the insulators and power interrupter arranged in cantilevered horizontal relationship with the beam which is attached to the vertical support structure. Operating links between phases are operatively connected in a push-pull relationship with the high voltage outdoor electric switches.

7 Claims, 7 Drawing Sheets

UNITIZED PHASE OVER PHASE TWO-WAY OR THREE-WAY HIGH VOLTAGE SWITCH ASSEMBLY WITH ONE VACUUM INTERRUPTER PER PHASE

CROSS-REFERENCE TO RELATED APPLICATION

This is application claims the benefit of U.S. Provisional Application No. 62/078,637 filed Nov. 12, 2014, which is incorporated herein by reference in its entirety.

BACKGROUND OF THE INVENTION

The invention relates to a unitized phase over phase two-way and three-way high voltage switch assembly for electrical switchgear such as air break disconnect switches used in transmission for the routing of power in multiple directions. And, in particular, to such a two-way and three-way high voltage switch assembly utilizing a single vacuum interrupter per phase.

U.S. Pat. No. 3,226,499 issued to Thomas E. Curtis, et al. on Dec. 28, 1965, which is incorporated herein by reference, discloses a load break switch gear including a plurality of side air break switches in combination with a single load interrupting switching device. The Curtis apparatus includes means for interconnecting each air break switch with the load interrupter during opening of the air break switches. The Curtis load interrupter includes a plurality of serially connected vacuum-break interrupters. Tandem operation of any number of vacuum-break interrupters is provided, whereby the transmission line voltages that maybe interrupted are greatly increased. The Curtis apparatus includes a frame 54, that as depicted in FIG. 2 of Curtis, is triangularly shaped and extends horizontally from a power pole 56. As depicted in FIG. 1 of Curtis braces apparently are attached below the frame 54 for support. Rotary insulators 48, 50 and 52 are vertically arranged at the corners or vertexes of the frame 54. A load interrupter 40 is secured to a support insulator 66 mounted centrally within the perimeter of frame 54. The load interrupter 40 is for extinguishing the arc upon opening of main switches 28-32, as described in detail in the aforesaid patent.

Traditionally such switch gear assemblies in a two-way or three-way switch configuration with one vacuum interrupter per phase in a three phase system have had problems with phase over phase spacing for a given voltage requiring special long expensive transmission poles. The phase over phase spacing is the minimum permissible distance between electrical phases. For example, the three-way switch assembly manufactured by Turner Electric Corporation of 9510 Clair Avenue, Fairview Heights, Ill. 62208 requires for a 115 kv switch assembly a minimum phase spacing of twenty feet. As described in Turner Electric Corporation sales brochure, entitled "Air Break Switch 3D-D001, Teco Air Switches, 15 KV-161 KV", copyright Turner Electric Corporation 1983, a relatively large phase spacing is required because of structural braces which are at electrical ground potential. The Turner air break switch is similar in structure and operation to the above-mentioned load break switch gear patent by Curtis. Braces are also required for the Turner switch because, for example for each phase in a 3-way arrangement; three side break switches are affixed to an equilateral triangular bracket arrangement attached to a vertical transmission pole in a similar manner as mentioned for the Curtis patent. The braces support the triangular bracket arrangement. One end of each of the side break switches is supported by a rotatable vertical insulator attached at one end to each vertex or corner of the triangular bracket. A vacuum interrupter is arranged coaxially vertically above another insulator which is stationary and positioned about in the center of the triangular bracket. The vacuum interrupter is supported by a cross member attached at one end at a vertex of the triangular bracket and at the other end to about the center of the opposite side of the bracket. The braces are attached at one end to the pole at a distance below the triangular bracket and at the other end at about each vertex of the triangular bracket. This arrangement requires a minimum clearance between the top of the vacuum interrupter and the brace supports to avoid establishing a path to ground via the interrupter and the triangular bracket supports. Also, in conjunction with this Turner switch assembly, as a common practice, a purely torsional drive is used for opening and closing each switch, which makes adjusting the switching sequence between phases very random due to the "wind-up" of the pipe which is in torsion. Also, with such three-way switches when installing the switches it is very time consuming because each phase has to be installed separately and the mechanical operating mechanism between the phases is field installed and adjusted.

U.S. Pat. No. 4,492,835 by John L. Turner, issued Jan. 8, 1985, which is incorporated herein by reference, describes a typical high voltage load interrupter device having a plurality of load interrupter contacts enclosed respectively in axially aligned vacuum bottles, each bottle containing a fixed contact and a second contact movable axially away from the fixed contact to open position and toward the fixed contact to closed position by an actuating mechanism. The bottles are positioned in a tubular housing of dielectric material by a series of stacking pedestals each formed with three equi-angularly spaced radial arms engaging the inner surface of the tubular housing. Each movable contact is normally resiliently biased toward closed position and is moved to open position by a toggle of the actuating mechanism having a pair of arms substantially aligned with the contacts and held in position by springs connected to arms on the operating shaft such that when the operating shaft is rotated by the operating arm, the above-mentioned springs break the toggle, causing the individual contacts to open. A reset spring returns the operating shaft and operating arm to ready position and causes the toggle to return the contacts to their normal closed positions.

It is therefore an object of the present invention to devise an improved phase over phase three-way switch assembly that overcomes the large space requirement of the prior art switch assembly requiring such brace supports between phases; and which has a more positive semi-non-torsional acting switch mechanism; and which is much less time consuming to adjust and which installs quicker as a unitized multi-phase assembly on a beam member. A two-way switch assembly is also disclosed.

SUMMARY OF THE INVENTION

The untized phase over phase two-way or three-way switch assembly of the present invention solves the problems of the prior art arrangement. The two-way or three-way switch assembly of the present invention is a phase over phase arrangement which, in the case of a three-way assembly, includes three arrays of three-way switches, i.e., three switches per phase, pre-mounted on a beam, one array for each phase. The beam in the operative position is vertical and attached to a vertical transmission pole. The cylindrically-shaped insulators of the present invention are cantilevered in such a manner that their axes extend axially horizontally in a cantilevered fashion from the vertical transmission pole, as opposed to the prior art arrangement with all the switch insulators being vertically oriented with their axes, vertically arranged, parallel to the vertical transmission pole. The unitized three phase three-way switch assembly is fully factory adjusted before being shipped to the job site. This arrangement of switches being pre-mounted on a beam for installation on a utility pole in a phase over phase arrangement is called a untized switch arrangement. The switches of the present invention for each phase are driven by a "push-pull" mechanical linkage instead of the prior art purely torsional drive which have so-called "wind-up" problems because of the length of pipe used to engage the switches. Together with a single power interrupter the array of three-switches for each phase forms a switching unit that is mounted to the beam without the need of the previously mentioned prior art support braces for the triangular bracket, for example, thereby reducing the minimum required distance between phases for a particular voltage switch assembly.

For a three-way switch configuration of the present invention, each array of three-switches includes a vertical break switch mounted between two side break switches, as opposed to the typical prior art arrangement of the previously described U.S. Pat. No. 3,226,499 issued to Curtis, et al and the three-way switch assembly previously described of Turner Electric Corporation which both use three side break switches for each phase. When either side break switch of the present invention opens, there is less electrical clearance to the vertical break switch parts as opposed to the use of a side break switch which would open to create an electrical clearance problem. Also, the horizontally mounted side break switch insulators of the present invention are preferably mounted with their axes in the same horizontal plane as the axis of the vacuum interrupter, this further reduces the electrical clearance between phases as opposed to the prior art arrangement which positioned the interrupter vertically in the center of the triangular bracket and which required the problematic supporting cross member and braces as previously mentioned. For a two-way switch configuration of the present invention the vertical break switch is eliminated.

These and other aspects of the present invention will be further understood from the entirety of the description, drawings and claims.

DETAILED DESCRIPTION OF THE PARTICULAR EMBODIMENTS

Figure 1:
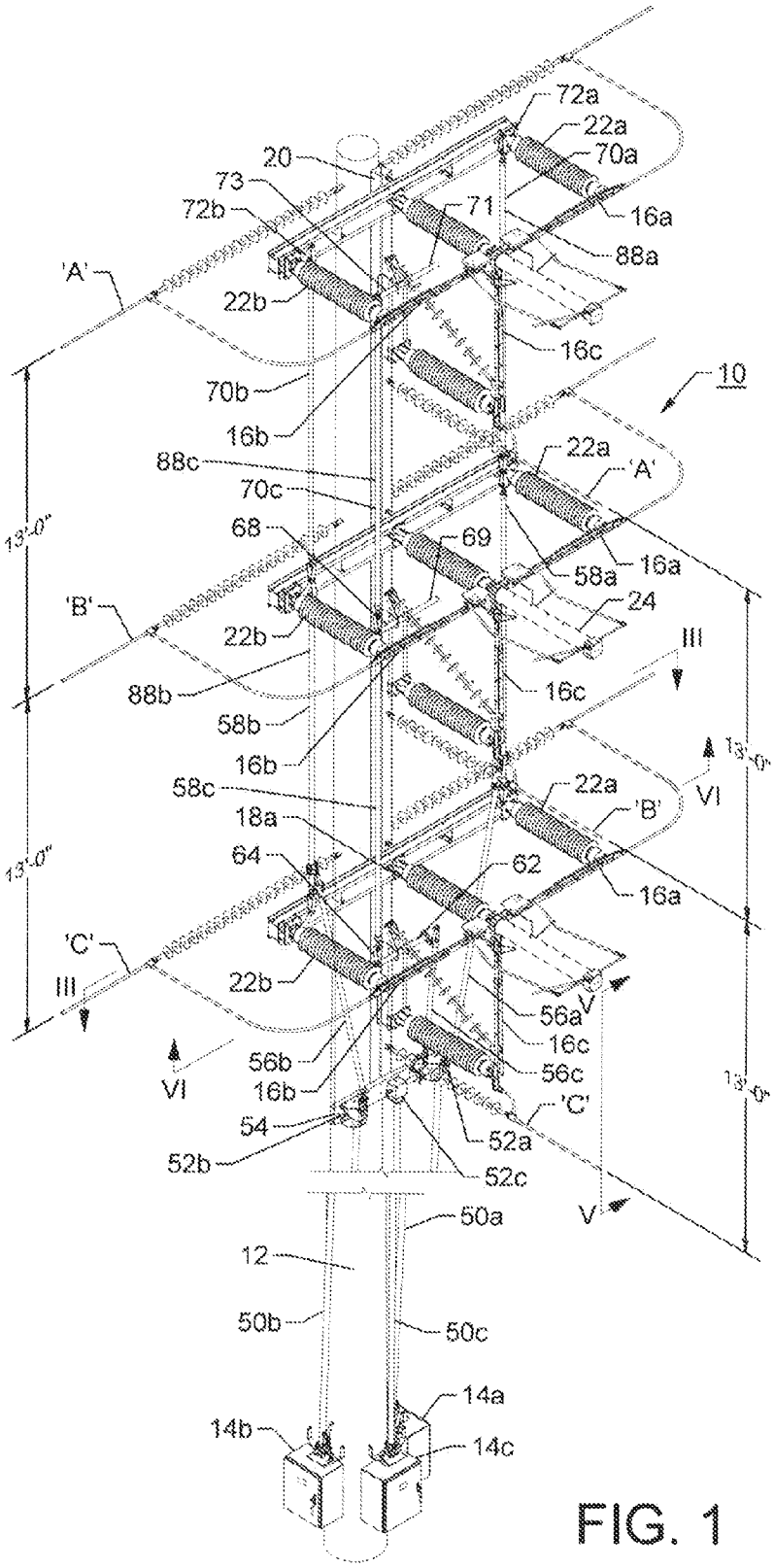
FIG. 1 is a perspective view of a unitized phase over phase three-way switch assembly of the present invention attached to a pole partially broken away with the switches closed.

FIG. 1 shows a unitized phase over phase high voltage 3-way high voltage switch assembly 10 mounted to an electric utility vertical pole 12 which typically is concrete or steel. The switch assembly 10 can handle voltages of, for example, 69 kV (thousand volts) to 161 kV with current carrying capacity of 1200 amperes to 2000 amperes. The switch assembly 10 is adapted to be engageable with a three phase alternating current electrical power system which includes an upper phase 'A', an intermediate phase 'B' and a lowest phase 'C'. The phase over phase 3-way switch assembly is typically operatively attached and engageable with three motor operators 14*a*, 14*b*, and 14*c*. The motor operators 14*a*, 14*b*, 14*c* may be such as sold by Cleaveland/Price Inc., the present assignee, as motor operator model no. TPC. More details of the attachment of the motor operators 14*a*, 14*b*, 14*c* to respective switches will be described subsequently.

Figure 2:
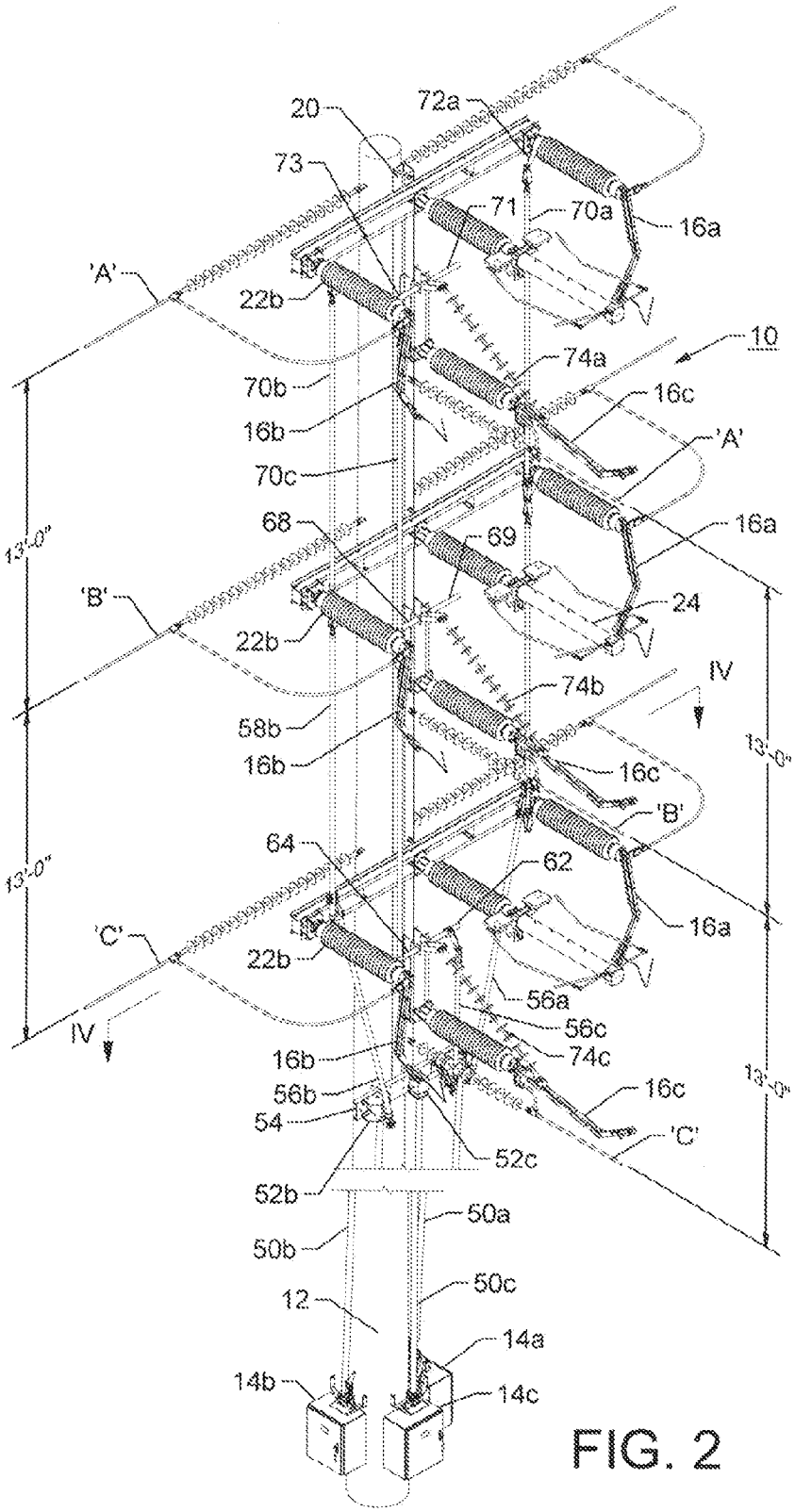
FIG. 2 is the same as FIG. 1 but with the three switches per phase open.
Figure 3:
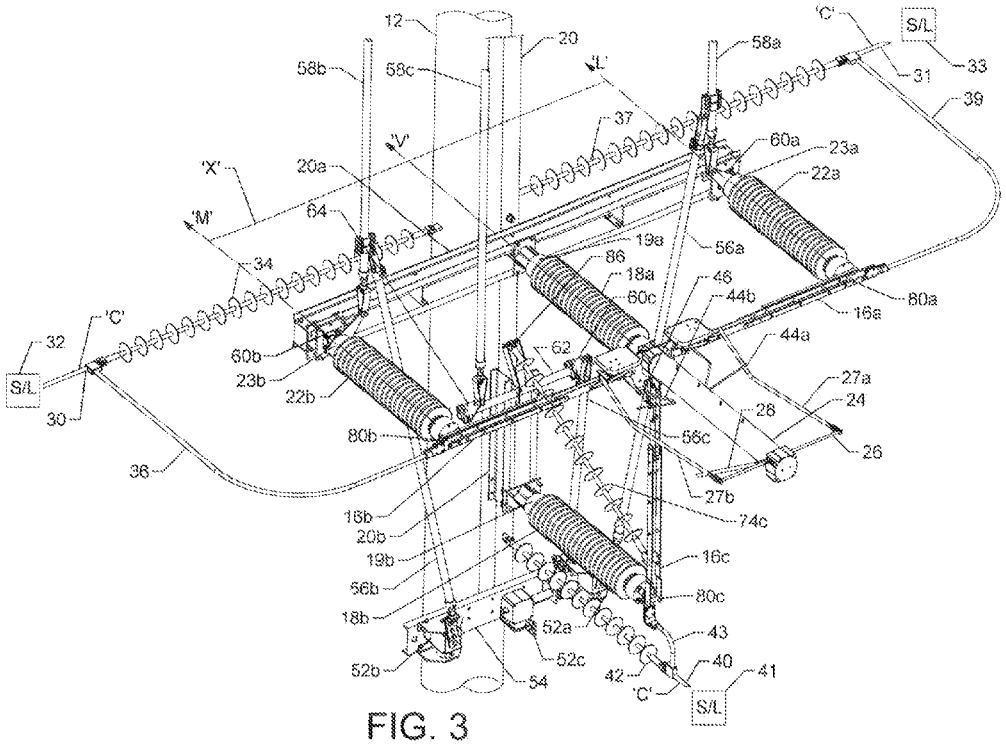
FIG. 3 is an enlarged perspective view of the lowest phase of FIG. 1 taken along the lines III-III of FIG. 1 and showing a switching unit of the bottom phase which is the same as for the middle phase and the top phase.
Figure 4:
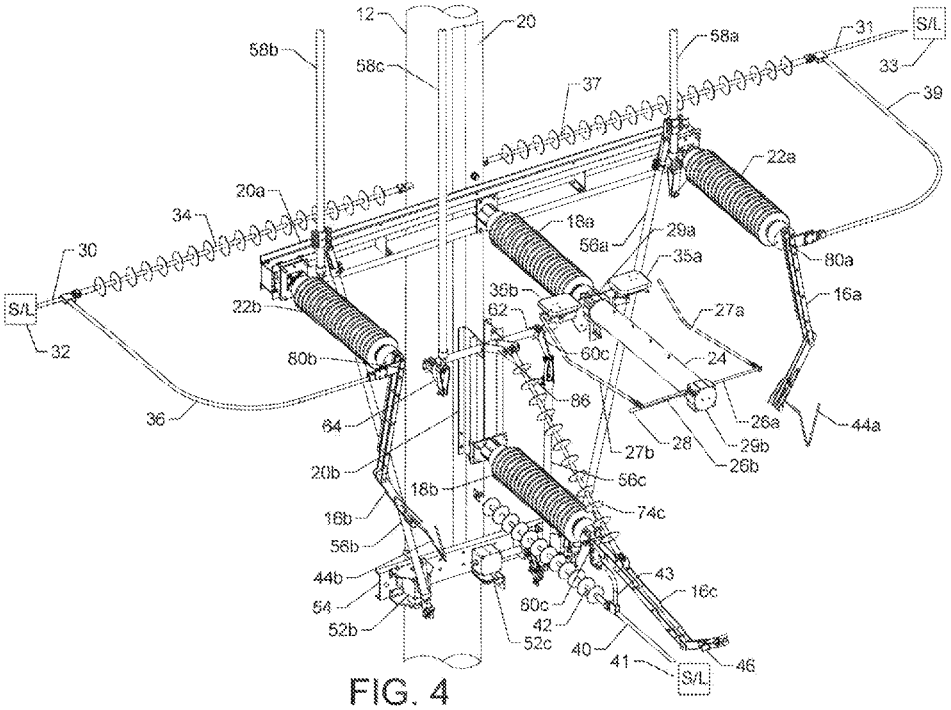
FIG. 4 is an enlarged perspective view of the bottom phase of FIG. 2. taken along the lines IV-IV of FIG. 2.
Figure 6:
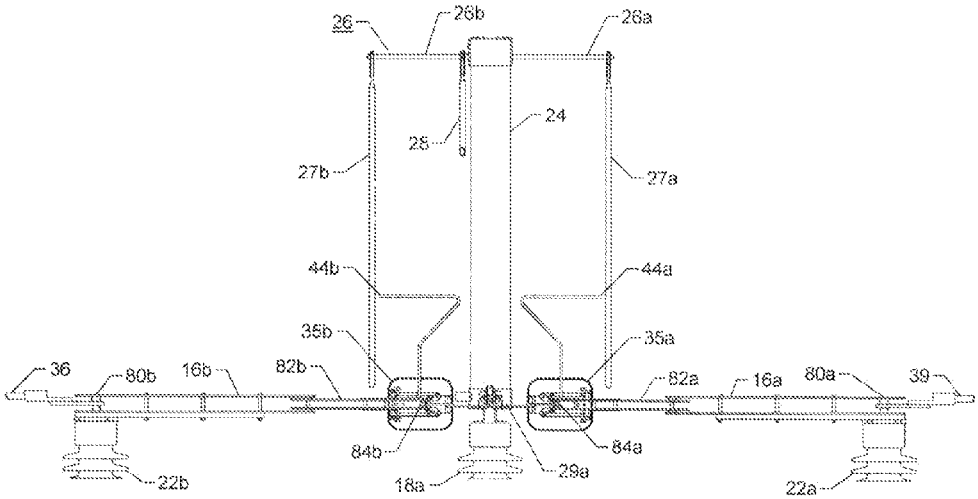
FIG. 6 is a bottom view taken along the lines VI-VI from FIG. 1 showing the contacts for the two side break switches engaging two jaws at the base of the interrupter; and, FIG. 7 is a perspective view of a two-way arrangement of the switch assembly similar to FIG. 3 except showing a two-way instead of a three-way switch arrangement.

Each of the three phases 'A', 'B' and 'C' has three switches 16*a*, 16*b*, and 16*c* arranged in an array corresponding to each phase as shown in FIGS. 1 and 2. The three switches 16*a*, 16*b*, 16*c* in each array can route electrical power in three ways as is known in the art. As can be seen, for example, from FIG. 3 with reference to lowest phase 'C', two stationary cylindrical insulators 18*a*, 18*b* are attached at one end 19*a*, 19*b* in a cantilevered horizontal fashion respectively to horizontal frame 20*a* and vertical frame 20*b*. The horizontal frame 20*a* and vertical frame 20*b* are attached to vertical beam 20 which in turn is attached to the vertical pole 12. As can be seen by reference to FIG. 3, horizontal frame 20*a* is arranged perpendicular to the vertical beam 20. The switch 16*c* is a vertical break switch and is attached between the two stationary insulators 18*a*, 18*b* and opens as shown in FIG. 4. Two rotating cylindrical insulators 22*a*, 22*b* are positioned and attached at one end 23*a*, 23*b* in cantilevered horizontal fashion on the frame 20*a*. The rotating cylindrical insulators 22*a*, 22*b* operate the switches 16*a*, 16*b* which are side break switches which open as shown in FIG. 4. As shown in FIG. 4, supported also in a cantilevered horizontal fashion coaxially at one end 29*a* by stationary insulator 18*a* is a cylindrical vacuum interrupter 24, also attached to frame 20*a*. As shown in FIG. 3. desirably, the horizontally mounted side break switch insulators 22*a*, 22*b* of the present invention are preferably mounted with their axes, respectively 'L' and 'M', lying in substantially the same plane 'X', which preferably is a horizontal plane. Also lying in the same plane 'X' is the axis 'V' of the vacuum interrupter 24 and the stationary insulator 18*a* which are coaxial. The vacuum interrupter 24 houses a plurality of vacuum bottles (not shown), as described in the previously mentioned Turner U.S. Pat. No. 4,492,835, electrically connected in series circuit arrangement for extinguishing the arc caused by the opening of a switch. The vacuum interrupter 24 at the other end 29*b* includes rotatable operating shaft 26 having side portions 26*a*, 26*b* having side break interrupter trip arms 27*a*, 27*b* respectively attached thereto as can be seen by reference to FIGS. 3, 4 and 6. The vacuum interrupter 24 also has attached at the end 29*b*, a vertical break trip arm 28 as shown in FIGS. 3 and 6. The trip arm 28 is used for tripping the vacuum interrupter 24 when the vertical break switch 16*c* opens to open contacts within each vacuum bottle (not shown) for extinguishing an arc. Blade trip bar 46 shown in FIG. 4 is attached to vertical break switch 16*c* and engages with arm 28 as the switch opens. The trip arm 28 is attached as shown in FIG. 6 to rotatable shaft side portion 26*b*. Blade trip bars 44*a*, 44*b* are respectively attached to switches 16*a*, 16*b*. When side break switch 16*a* opens, it actuates trip arm 27*a* to trip the vacuum interrupter 24. In a similar manner, when side break switch 16*b* opens it actuates trip arm 27*b* to trip the vacuum interrupter 24.

Figure 5:
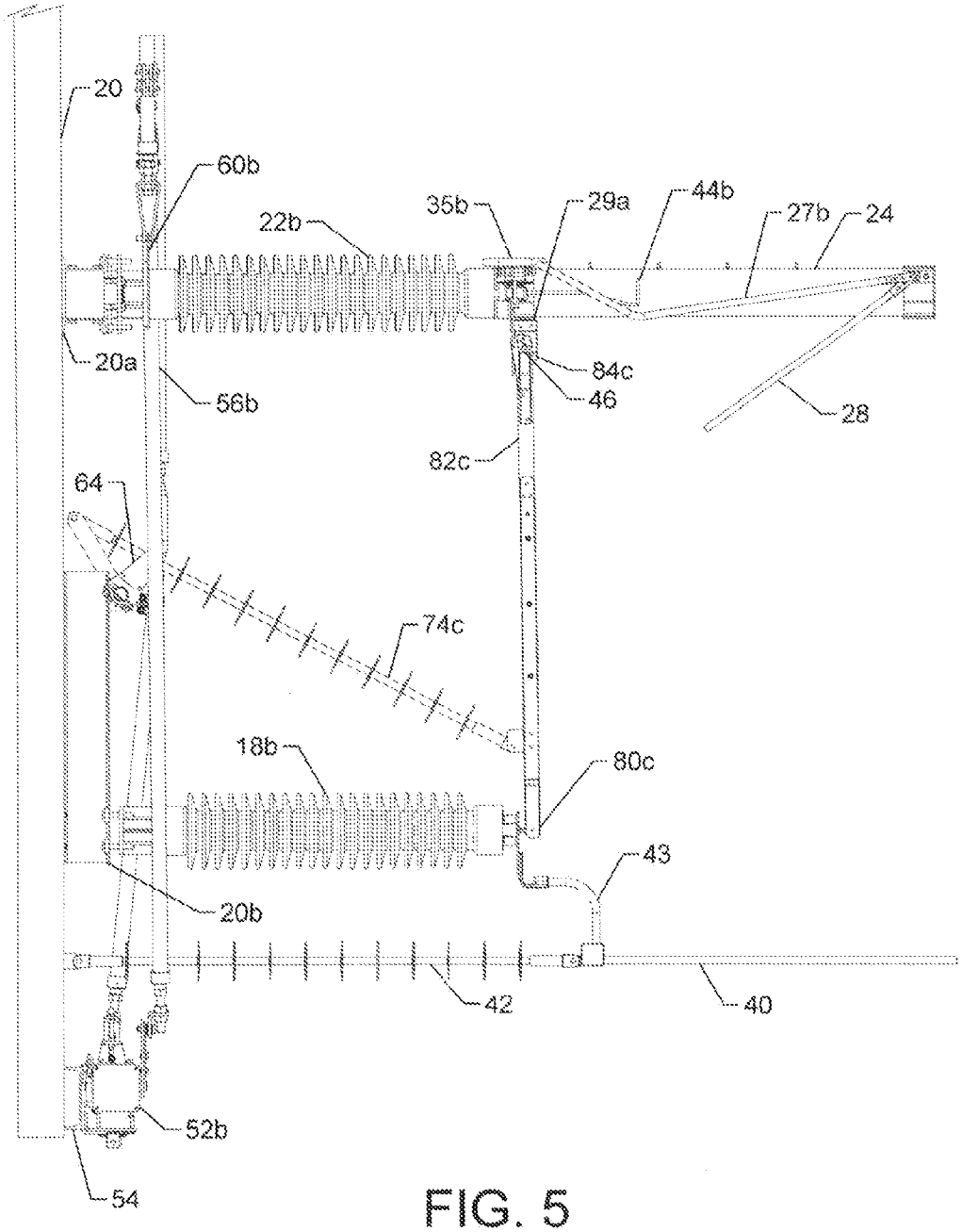
FIG. 5 is an elevation side view taken along the lines V-V from FIG. 1 of the bottom phase showing the vertical break switch blade engaged with the contact at the base of the interrupter while a side break switch jaw is still engaged with another contact at the interrupter base.

A first transmission line 30 from a first power source or load 32, indicated by a dashed square in FIGS. 3 and 4, is attached to a first strain insulator 34 which insulates the transmission line 30 from pole 12 while providing sufficient support for the transmission line. Electrical current through first transmission line 30 is conducted via first jumper conductor 36 to hinge end 80*b* of side break switch 16*b*. The blade end 82*b* of side break switch 16*b* contacts a jaw 84*b* at the one end 29*a* of the vacuum interrupter 24, as shown in FIG. 6. A second transmission line 31 from a second power source or load 33, indicated by a dashed square in FIGS. 3 and 4, is attached to second strain insulator 37. Electrical current through second transmission line 31 is conducted via second jumper conductor 39 to hinge end 80*a* of side break switch 16*a*. The blade end 82*a* of side break switch 16*a* contacts jaw 84*a* at the one end 29*a* of the vacuum interrupter 24. A third transmission line 40 from a third power source or load 41, indicated by a dashed square in FIGS. 3 and 4, is attached to third strain insulator 42. Electrical current through the third transmission line 40 is conducted via jumper conductor 43 to the hinge end 80*c* of vertical break switch 16*c* better shown in FIG. 5. The blade end 82*c* of vertical break switch 16*c* makes contact at jaw 84*c* at the one end 29*a* of the vacuum interrupter.

The motor operators 14*a*, 14*b*, 14*c* are preferably attached near the bottom of the pole 12 so as to be easily accessible for servicing and operation. The pole 12 may be 100 feet in height, for example. Of course instead of the use of three motor operators, the switches may be operated manually to provide rotary motion by three manual rotary operators such as a swing handle or geared hand crank, not shown in the drawings. Torsional drive pipes 50*a*, 50*b*, 50*c* are respectively operatively attached to motor operators 14*a*, 14*b*, 14*c* and as shown in FIGS. 1 and 2 extend upwardly to gear boxes 52*a*, 52*b*, 52*c*. The gear boxes 52*a*, 52*b*, 52*c* may be such as manufactured and sold by Cleaveland/Price Inc., the present assignee. The gear boxes 52*a*, 52*b*, 52*c* convert torsional motion to push-pull motion. The motor operators 14*a*, 14*b*, 14*c*, may also be such as manufactured and sold by Cleaveland/Price Inc., the present assignee, and provide torsional or rotary motion to the lower drive pipes 50*a*, 50*b*, 50*c*. The torsional drive pipes 50*a*, 50*b*, and 50*c* may be 40 feet to 60 feet in length, for example. The gear boxes 52*a*, 52*b*, 52*c* are mounted on bottom member 54 which is attached to beam 20. Extending upwardly respectively from gear boxes 52*a*, 52*b*, 52*c* are lower push-pull links 56*a*, 56*b*, 56*c* shown in FIGS. 3 and 4. The gear boxes convert the torsional movement of torsional drive pipes 50*a*, 50*b*, 50*c* to a push-pull movement of the lower push-pull links 56*a*, 56*b*, 56*c*. The lower push-pull links 56*a*, 56*b*, 56*c* transmit the push-pull motion to the three phases 'A', 'B' and 'C' as follows. The lower push-pull links 56*a*, 56*b*, respectively extend from gear boxes 52*a*, 52*b* to rotating insulator lever 60*a*, 60*b* better seen in FIG. 3. The lower push-pull link 56*c* is connected to lever 60*c* which rotates horizontal shaft 62 which rotates lever 86 which operates push-pull insulator 74*c* to open switch 16*c*, as shown in FIGS. 3 and 4.

The other end of lower horizontal shaft 62 is attached to lever 64. Intermediate links 58*a*, 58*b*, 58*c* respectively extend upwardly from phase 'C' to phase 'B' and upper links 70*a*, 70*b*, 70*c* extend from phase 'B' to phase 'A' as shown in FIGS. 1 and 2. The operation of phases 'B' and 'A' are the same as for lowest phase 'C' and therefore is not repeated.

With reference to FIGS. 1 and 3, activation of motor operator 14*b*, for example, causes a rotational movement of torsional drive pipe 50*b* which per gear box 52*b* converts the rotational movement to a linear push-pull movement of lower link 56*b* to open switch 16*b*. With reference to FIG. 1, assuming side break switch 16*b* for each phase is closed with the resulting movement of gear box 52*b*, the lower link 56*b*, the intermediate link 58*b* and the upper link 70*b*, constitute an operating link unit 88*b* are caused to move in unison to rotate insulators 22*b* to simultaneously cause all three side break switches 16*b* of phases 'A', 'B', and 'C' to open, as shown in FIG. 2. As the side break switch 16*b* opens it cases side break interrupter trip arm 27*b* to move to actuate the vacuum interrupter 24. A similar operation occurs with regard to the opening and closing of the other side break switch 16*a* and vertical break switch 16*c*. Side break switch 16*a* of each phase 'A', 'B', and 'C' is caused to open by the movement of gear box 52*a* with resulting movement of the lower link 56*a*, the intermediate link 58*a* and the upper link 70*a*, constituting an operating link unit 88*a*, are caused to move in unison to rotate insulators 22*a* to simultaneously cause all three side break switches 16*a* of phases 'A', 'B', and 'C' to open. Likewise, vertical break switch 16*c* of each phase 'A', 'B', and 'C' is caused to open by the movement of gear box 52*c* with resulting movement of the lower link 56*c*, the intermediate link 58*c* and the upper link 70*c*, constituting an operating link unit 88*c*. With reference to FIGS. 3 and 4, with regard to the vertical break switch 16*c*, it has blade trip bar 46 attached. When the vertical break switch 16*c* is caused to open trip bar 46 causes vertical break trip arm 28 to move to actuate the vacuum interrupter 24. The trip arm 28 and trip bar 46 are also shown clearly by reference to FIG. 5. FIG. 6 also shows trip arms 28, 27*a* and 27*b* and trip bars 44*a* and 44*b*.

As mentioned, utilizing the hybrid torsional-push-pull arrangement of the present invention to open and close switches 16*a*, 16*b*, 16*c* eliminates any problem with the prior art purely torsional drive "wind up" because there is now only push-pull motion between the phases 'A', 'B' and 'C' where accurate sequencing of phases is needed. Also, with the present invention the braces to support the triangular bracket of the prior art have been eliminated allowing for a smaller minimal distance or clearance between phases. Also, this reduced clearance comes about by the present invention, for the three-way switch configuration, that uses one vertical break switch located centrally between and at right angles to the two side break switches so that when the two side break switches open, there is electrical clearance to the vertical break switch parts. Also, by having the side break switch insulators having their axes in line or in the same plane as the axis of the vacuum interrupter 24, further reduces the electric clearance necessary between phases. For example, by utilizing the present invention for a 115 kV installation the required spacing between phases is only 13 feet compared to 20 feet specified for the prior art arrangement described in the previously mentioned Turner Electric Corporation sales brochure, entitled "Air Break Switch 3D-D001, Teco Air Switches, 15 KV-161 KV", as dimension "G" on the last page, copyright Turner Electric Corporation 1983. For such a 115 kV installation 13 feet is a typical minimal allowable safe clearance between phases. The present invention results in significant cost savings for the cost of the transmission pole and also results in a shorter unit which is unitized and can be shipped on a truck as a complete unitized unit. This complete unitized unit of the present invention also reduces the cost of installation, because the linkage between phases is factory adjusted instead of field adjusted.

Figure 7:
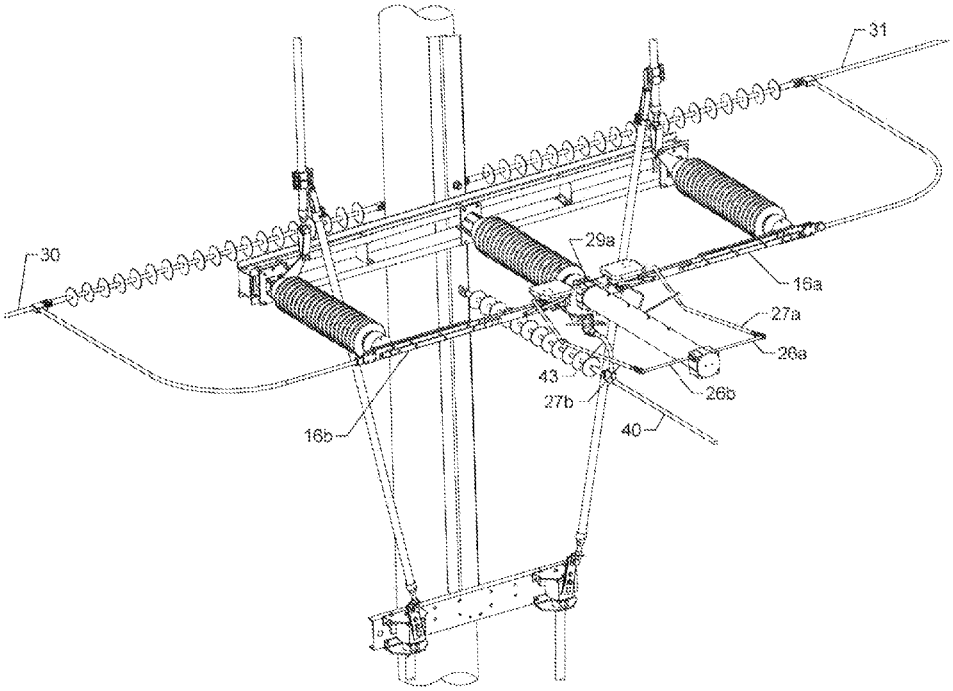

A two-way switch assembly is shown in FIG. 7 which has the same advantages as described for the three-way switch assembly of FIG. 3, but only two side break switches 16*a*, 16*b* are necessary; no vertical break switch is required. The third transmission line conductor 40 dead-ends to the pole and is jumpered to the one end 29*a* of vacuum interrupter 24 instead of the hinge end 80*c* of the not needed vertical break switch 16*c*. This allows current from third transmission line conductor 40 to be routed to either first transmission line conductor 30 or second transmission line conductor 31 depending on the open or closed position of the switches 16*a* or 16*b*.

What is claimed is:

1. In combination with switch gear for interconnecting three electrical power transmission lines per electrical phase of a three phase high voltage outdoor electrical system including:

three switching units each including two or three high voltage outdoor air-break electric power switches and a single power interrupter, each of the switching units operatively arranged in one of the three electrical phases and operatively configured in a two-way switch configuration or a three-way switch configuration for interconnecting the three electrical power transmission lines per electrical phase, the three electrical phases and the switching units operatively configured in a phase over phase relationship including a top phase, a middle phase and a bottom phase, the improvement which comprises:

the three switching units operatively secured to an elongated beam member as a single unitized assembly in the operative position affixed vertically to an electric utility vertical structure;

each of the switching units in operative interconnected switchable relationship with the three electrical transmission lines of the respective electrical phase via the single power interrupter having a cylindrical shape;

each of the switching units including first and second side break high voltage air-break outdoor power switches in the two-way switch configuration, each of the first and second side break switches at one end thereof in operative engagement with a rotatable cylindrically-shaped insulator, each of the first and second side break switches in operative and electrical connection at the other end thereof with the single cylindrically-shaped power interrupter operatively mounted to a coaxial first stationary cylindrically-shaped insulator;

the single untized assembly further comprising the rotatable cylindrically-shaped insulators, the coaxial first stationary cylindrically-shaped insulator, and the cylindrically-shaped single power interrupter for each of the switching units mounted to the elongated beam member and having the axes of the rotatable cylindrically-shaped insulators, the axis of first stationary cylindrically-shaped insulator, and the axis of the single cylindrically-shaped power interrupter lying substantially in the same plane and in cantilevered horizontal relationship with the elongated beam member upon attachment to the electric utility vertical structure, the single power interrupter being disposed centrally between the first and second side break switches;

in the three-way switch configuration each of the switching units also including a vertical break high voltage air-break outdoor power switch, the vertical break switch at one end thereof in operative and electrical connection with the first and second side break switches and the single cylindrically-shaped power interrupter, a second stationary cylindrically-shaped insulator mounted to the elongated beam member and having the axis thereof in cantilevered horizontal relationship with the vertical elongated beam member upon attachment to the electric utility vertical structure, the vertical break switch affixed at the other end to the second stationary cylindrically-shaped insulator, the vertical break switch disposed centrally between and at right angles to the first and second side-break switches;

push-pull linkage including operating links disposed between the top electrical phase, the middle electrical phase, and the bottom electrical phase operatively connected in operating link units in a push-pull relationship to open and close simultaneously upon actuation the first side break switch or the second side break switch of each of the electrical phases in the two-way switch configuration or to open and close simultaneously the first side break switch or the second side break switch or the vertical break switch of each of the electrical phases in the three-way switch configuration; and, means for actuating to open or close simultaneously the first side break switch or the second side break switch of each of the electrical phases in the two-way switch configuration or to open or close simultaneously the first side break switch or the second side break switch or the vertical break switch of each of the electrical phases in the three-way switch configuration.

2. The switch gear of claim 1, wherein the means for actuating to open or close simultaneously the first side break switch or the second side break switch of each of the electrical phases in the two-way switch configuration or to open or close simultaneously the first side break switch or the second side break switch or the vertical break switch of each of the electrical phases in the three-way switch configuration switching units comprising two motor operators or two manual rotary operators for the two-way switch configuration and three motor operators or three manual rotary operators for the three-way switch configuration, each of the motor operators or manual rotary operators having a lower torsional operating pipe connected to a gear box in operative connection with one of the operating link units of the push-pull linkage.

3. The switch gear of claim 2, wherein each of the gear boxes includes a miter gear which converts torsional motion to push-pull motion.

4. The switch gear of claim 1, wherein for the two-way switch configuration, the first side break switch of each electrical phase connected in circuit at the one end thereof to a first of the three transmission lines, the second side break switch of each electrical phase connected in circuit at one end thereof to a second of the three transmission lines, the other ends of the first and second side break switches connected in circuit with the third of the three transmission lines, whereby power is routed through the three transmission lines per electrical phase via the two-way switch configuration with the centrally located power interrupter for each electrical phase being operated as the switches open.

5. The switch gear of claim 1, wherein for the three-way switch configuration, the first side break switch of each electrical phase connected in circuit at the one end thereof to a first of the three transmission lines, the second side break switch of each electrical phase connected in circuit at one end thereof to a second of the three transmission lines, the other ends of the first and second side break switches of each electrical phase connected in circuit to one end of the vertical break switch of the respective electrical phase, the other end of the vertical break switch connected in circuit with the third of the three transmission lines, whereby power is routed through the three transmission lines via the three-way switch configuration with the centrally located power interrupter for each electrical phase being operated as the switches open.

6. The switch gear of claim 1, wherein the single cylindrically-shaped interrupter of each electrical phase includes an operating shaft for actuating the power interrupter, in the two-way switch configuration the power interrupter includes two trip arms operatively connected to the operating shaft, the first side break switch for engaging a first of the trip arms upon opening of the first side break switch, the second side break switch for engaging a second of the trip arms upon opening of the second side break switch.

7. The switch gear of claim 6, wherein in the three-way switch configuration the single cylindrically-shaped power interrupter of each electrical phase includes a third trip arm operatively connected to the operating shaft of the single cylindrically-shaped power interrupter, the vertical break switch for engaging the third trip arm upon the opening of the vertical break switch.

* * * * *